United States Patent [19]

Higashio et al.

[11] Patent Number: 4,866,486

[45] Date of Patent: Sep. 12, 1989

[54] COPYING MACHINE WITH SIMUL-COLOR COPY FUNCTION AND DIVISIONAL COPY FUNCTION

[75] Inventors: Kimihiko Higashio; Masazumi Ito, both of Osaka, Japan

[73] Assignee: Minolta Camera Kabushiki Kaisha, Osaka, Japan

[21] Appl. No.: 206,352

[22] Filed: Jun. 14, 1988

[30] Foreign Application Priority Data

Jun. 15, 1987 [JP] Japan ..... 62-148827
Nov. 6, 1987 [JP] Japan ..... 62-281852

[51] Int. Cl.[4] ..... G03G 15/01; G03G 15/09

[52] U.S. Cl. ..... 355/326; 355/251; 355/235

[58] Field of Search ..... 355/4, 25, 14 R, 14 D, 355/8, 3 DD, 55, 60, 61

[56] References Cited

U.S. PATENT DOCUMENTS 4,659,207 4/1987 Yoshikazu ..... 355/8
4,688,930 8/1987 Ohno ..... 355/25
4,739,372 4/1988 Watanabe ..... 355/25

*Primary Examiner*—R. L. Moses
*Attorney, Agent, or Firm*—Burns, Doane, Swecker & Mathis

[57] ABSTRACT

A copying machine capable of executing a divisional copy mode (book copy mode) wherein an original of two image sides, i.e., two open-out successive pages of a book is copied separately based on one copy instruction and a simul-color copy mode wherein a copy image of two or more colors can be obtained by changing over the developing units to be used during one copying operation. To execute the simul-color copy mode, the copying machine includes a color dividing position for dividing one of image sides into a plurality of color regions.

In the case where the divisional copy mode and simul-color copy mode are simultaneously designated, two image sides are separately copied, and also, one of the image sides in which the color dividing position exists is copied to obtain a multi-color copy image by the simul-color copy mode.

15 Claims, 18 Drawing Sheets

| COLOR OF TONER | SW1 | SW2 |
|---|---|---|
| BLACK | ON | ON |
| RED | ON | OFF |
| YELLOW | OFF | ON |
| — | OFF | OFF |

COPYING MACHINE WITH SIMUL-COLOR COPY FUNCTION AND DIVISIONAL COPY FUNCTION

BACKGROUND OF THE INVENTION

1. Field of the Invention:

The present invention relates to a copying machine having a simul-color copy function and a divisional copy function.

2. Description of the prior Art:

With the technological development in recent years, copying machines have had various functions. One of these is a divisional copy function (book copy mode) wherein an original of two image sides, i.e., two open-out successive pages of a book, is placed on a document support table to execute copying or scanning towards each image side based on one copy instruction. This divisional copy function requires a divisional reference line provided between two image sides, said divisional reference line being fixedly set or being set by calculating from the magnification ratio and paper size.

On the other hand, the present inventors have proposed in U.S. Patent Application Serial No. 148,423 filed on Jan. 25, 1988 in the names of Kusuda et al. a simul-color copy function in which a copy image of two or more colors can be obtained by selectively changing over the developing units to be used during the scanning operations for one image, each of said developing units containing tone of a different color.

SUMMARY OF THE INVENTION

Accordingly, the main object of the present invention is to provide a copying machine capable of simultaneously executing a simul-color copy function and a divisional copy function.

Another object of the present invention is to provide a copying machine which is easy to use when using a simul-color copy function and a divisional copy function simultaneously.

These and other objects of the invention can be accomplished by providing a copying machine comprising a platen on which an original is placed; a photosensitive member; scanning means for scanning the original on the platen to project a narrow, elongated image of the original onto the photosensitive member; image forming means arranged around the photosensitive member and comprising a plurality of developing units, each of which containing toner of a different color; input means for inputting the instruction to start the image forming operation; means for establishing an area dividing position which divides a copying area on the platen into two copying areas and in the scanning direction; first mode designating means for designating a divisional copy mode in which two copying areas divided at the area dividing position are separately and successively copied; means for setting a color dividing position which divides one of the copying areas on the platen into a plurality of color regions in the scanning direction; second mode designating means for designating a simul-color copy mode in which a multi-color copy image is obtained by selectively changing over a plurality of developing units to a plurality of regions specified at the color dividing position during one copying operation; and control means, when the first and second mode designating means simultaneously designate the divisional copy mode and the simul-color copy mode, for controlling the scanning means and the image forming means such that two copying areas specified at the area dividing position are separately copied, as well as for effecting the change-over control of the developing units toward the copying area including the color dividing position during the copying operation.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

A copying machine applying the present invention will be explained hereinafter with reference to the drawings.

Figure 1:
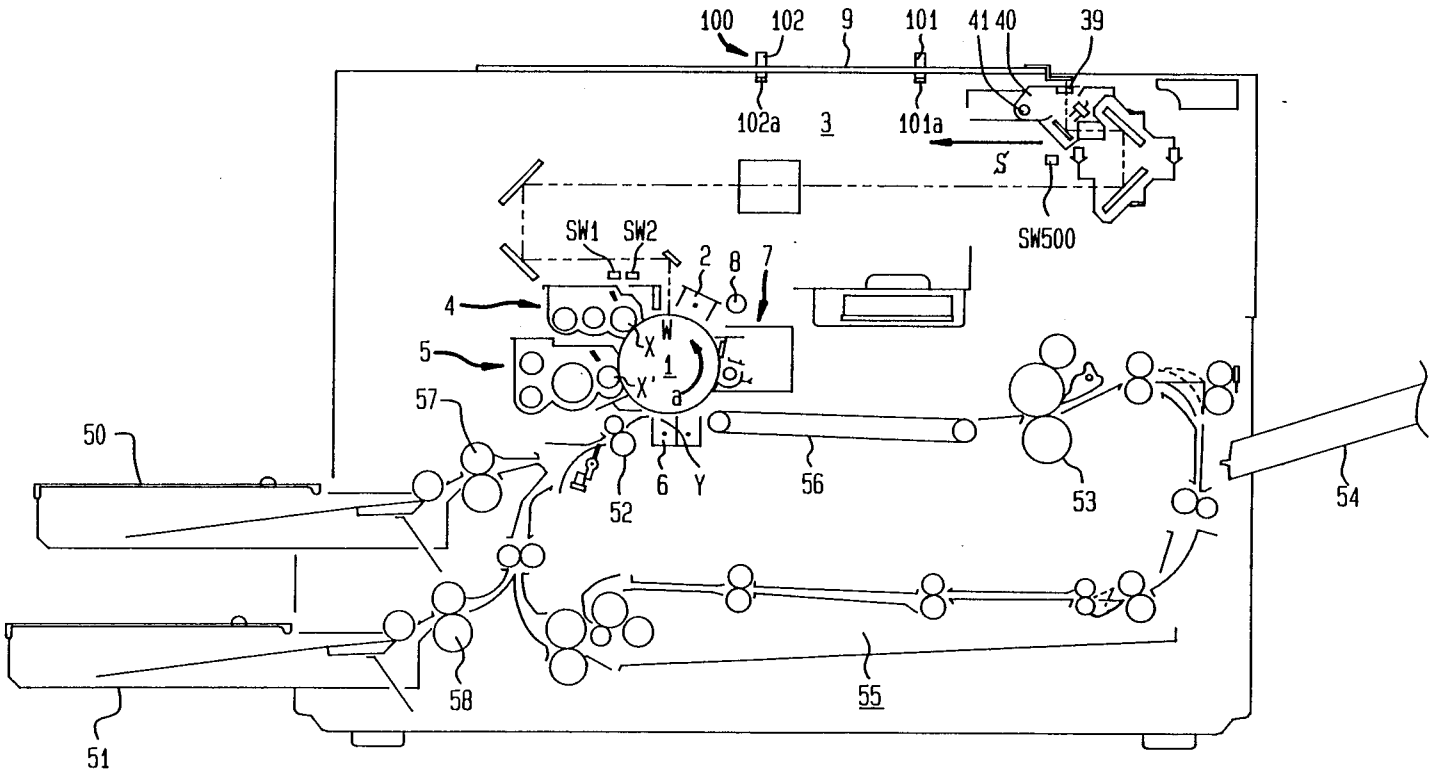
FIG. 1 is a schematic sectional view of a copying machine embodying the present invention.

FIG. 1 is a section view schematically showing the copying machine, the construction of which will be explained together with its normal copying operation.

A photoreceptor drum 1 rotatably provided in the direction of an arrow a is uniformly charged by a charger 2.

A scanner 40 having an exposure lamp 41 is movably provided below and adjacent to a transparent original document platform 9 of a glass material or the like disposed at the upper portion of the machine main body and projects light onto an original document (not shown) placed on said platform 9, while performing the scanning operation in the direction of an arrow S. Then, the light reflected from the original document is projected onto the photosensitive surface of the photoreceptor drum 1 via reflecting mirrors and a lens assembly through an exposure point W, and thus, an electrostatic latent image corresponding to the image of the original document is formed on said drum 1.

The electrostatic latent image thus formed is developed into a visible toner image at a developing region X or X' corresponding in position to the first developing unit 4 or second developing unit 5, thereby forming the toner image which is the reproduction of the original document image.

Meanwhile, the copy paper sheet is supplied selectively from a paper feeding section 50 or 51 provided at the lower left portion of the apparatus in FIG. 1, and is transported to a transfer region Y confronting the transfer charger 6 in timed relation with respect to the toner image formed on the photoreceptor drum 1. After the toner image has been transferred onto the copy paper sheet, the copy paper sheet is transported between a pair of fixing rollers 53 by means of a transport belt 56 movably supported by rollers so that the toner image is fixed thereon by heat fusion of toner, and is then discharged onto a discharge tray 54.

The copying apparatus shown in FIG. 1 has the construction for executing a duplex copying operation. If a duplex copying mode has been selected, the copy paper sheet with the image formed on its front face is transported into a duplex device 55 so as to be turned over in its front and reverse faces thereat, and then, again transported to the transfer region Y, while at an optical system 3 and around the photoreceptor drum 1, a second copying operation is performed in a similar manner as mentioned before so as to form the image on the reverse face of the copy paper sheet this time.

The toner remaining on the photosensitive surface of the photoreceptor drum 1 is scraped off therefrom by a cleaning device 7, and further, residual charge thereon is also erased through irradiation of light by an erase lamp 8 in preparation for subsequent development.

In addition to the standard copying as described so far, the copying machine is capable of effecting a function to obtain a composite copy in two colors by subjecting the scanner 40 to one scanning function (referred to as "simul-color copying" hereinafter). For this purpose, an image editing mechanism 100 is added and special mechanisms are, respectively, provided for developing units 4 and 5 as well as an operating panel 70 shown in FIG. 11.

In the first place, the developing units 4 and 5 will be explained hereinafter.

The first and second developing units 4 and 5 are removably mounted to the machine main body and can be replaceable with a developing unit having the same structure as the developing units 4 and 5 and accommodating developer of a different color. In the present embodiment, these developing units 4 and 5 can suitably be replaced with a black developing unit accommodating developer composed of black toner and carriers, a red developing unit accommodating developer composed of red toner and carriers or a yellow developing unit accommodating developer composed of yellow toner and carriers.

Accordingly, there arises a need to provide means for discriminating which developing unit, i.e., the black, red or yellow developing unit is mounted to the machine main body as the first and second developing units 4 and 5.

In the present embodiment, either one of the black, red or yellow developing units is selectively mounted as the first developing unit 4 with the black developing unit always mounted as the second developing unit 5.

In view of this, two magnet switches SW1 and SW2 are provided at the developing unit providing portion of the machine main body. On the other hand, the black developing unit is provided with two magnets at the portion opposite to the switches SW1 and SW2, the red developing unit with a magnet at the portion opposite to the switch SW1 and the yellow developing unit with a magnet at the portion opposite to the switch SW2, these magnets not being shown.

More specifically, when the black developing unit is installed, the switches SW1 and SW2 are turned on. When the red developing unit is installed, only the switch SW1 is turned on, and in the case of the yellow developing unit, only the switch SW2 is turned on. If neither one of the developing units is mounted, both switches SW1 and SW2 are turned off. The on/off states of both switches are illustrated in a color table of FIG. 10. The signals of the switches SW1 and SW2 are outputted to a first CPU 621, which will be explained later.

Figure 2:
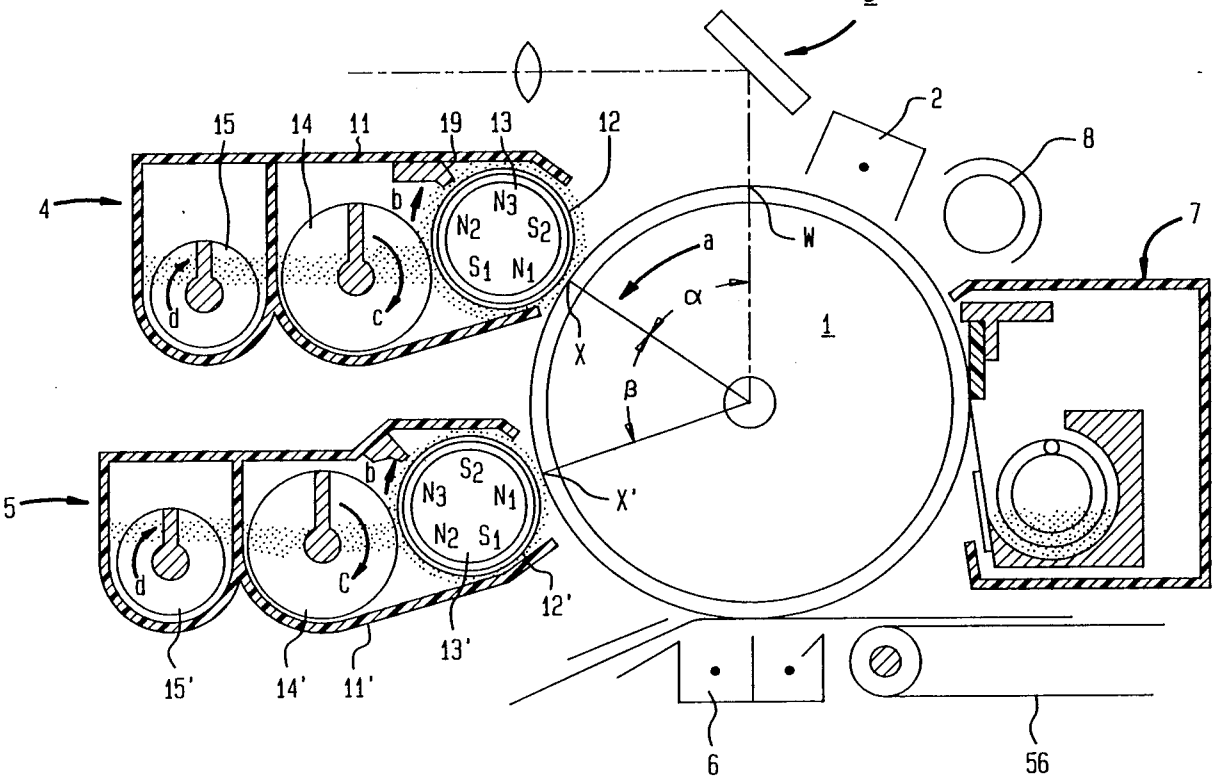
FIG. 2 is a sectional view showing the arrangement and constructon of the first and second developing units 4 and 5.
Figure 3:
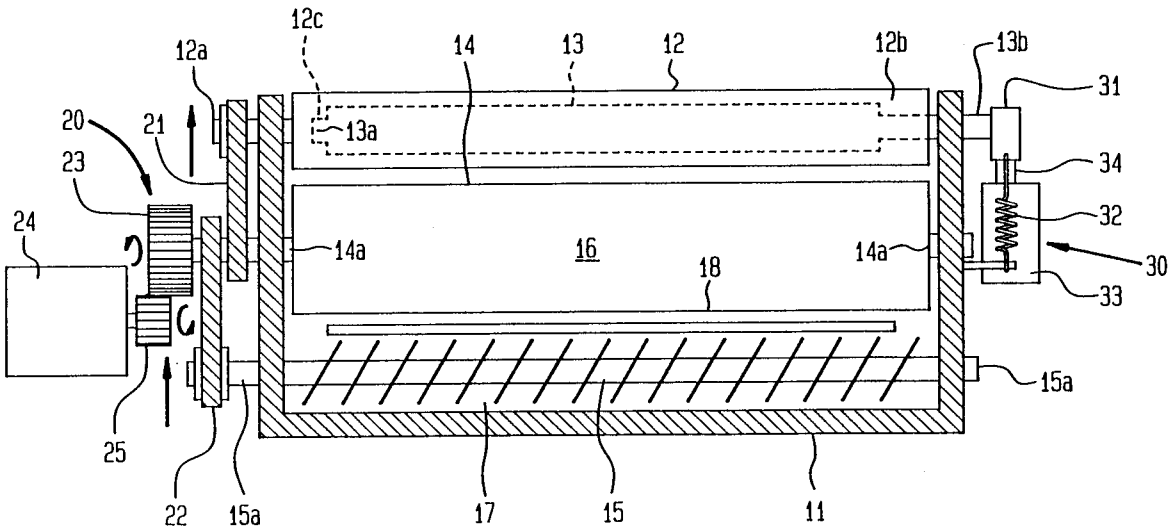
FIG. 3 is a cross-sectional view showing the first developing unit 4.
Figure 4:
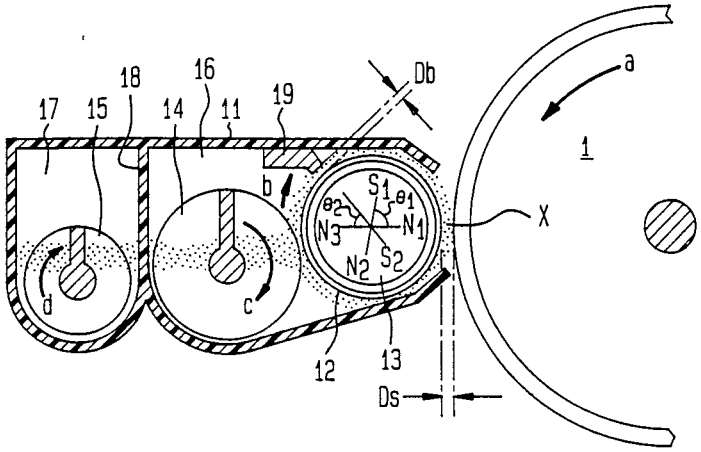
FIG. 4 is a sectional view showing the plurality arrangement of the magnet roller 13 of the developing unit in the state capable of developing.

Referring particularly to FIGS. 2 to 4, each of the developing units 4 and 5 has a construction generally equal to the other and includes a developing tank 11, 11' open at its one edge adjacent to the photosensitive surface of the photoreceptor drum 1, and a developing sleeve 12, 12' a supply roller 14, 14' and a screw 15, 15' rotatably provided within said developing tank in that order sequentially from the side of the photoreceptor drum 1.

The developing sleeve 12, 12' is made of a non-magnetic electrically conductive material formed into a cylindrical shape of 24.5 mm in diameter and is formed with very small concave and convex portions or undulations on its outer peripheral surface by a sand blasting process, and confronts the photosensitive surface of the photoreceptor drum 1 at the developing region X or X' through a developing gap Ds (=0.6mm), with rotational angles from the exposure point W to the developing regions X and X' being respectively set as $\alpha$ and $(\alpha+\beta)$, wherein $\alpha$ is set at 56' and $\beta$ at 52' in this embodiment.

Meanwhile, at the back face side of the developing sleeve 12, 12' with respect to the developing regon X, a magnetic brush bristle height restricting plate 19, 19' is provided at an upper inner portion of the developing tank 11, 11' so as to confront the surface of said developing sleeve 12, 12' through a bristle height restricting gas Db (=0.4 mm).

Within the developing sleeve 12, 12', there is disposed a magnet roller 13, 13' having a plurality of magnets extending in the axial direction, and magnetic forces of magnetic poles N1, N2 and N3, and S1 and S2 located at outer peripheral faces of such magnets are respectively set as N1 =1000 G, N2 and N3 =500 G, and S1 and S2 =800 G.

As shown in FIG. 4, the center of the magnetic pole N1 is located at a position displaced clockwise from the center of the magnetic pole S1 by θ'(80°), while the center of the magnetic pole N3 is adapted to be located at a position displaced counterclockwise from the portion confronting the bristle height restricting member 19 by θ2 (40'), under the state where the magnetic pole N1 faces the surface of the photoreceptor drum 1.

As is seeen from FIG. 3, the magnet roller 13 has one end 13a of its shaft supported in a bearing recess 12c formed in the developing sleeve 12, and the other end 13b thereof suported by a side wall of the developing tank 11, so as to be rotatable through a predetermined angle (θ1=40°) by a displacing means 30 to be described in detail hereinbelow.

Meanwhile, the developing sleeve 12 has its bearing portion 12*b* at the right side in FIG. 3 supported by the shaft 13*b* of the magnet roller 13, with its shaft 12*a* at the left side being supported by the side wall of the developing tank 11, so as to be driven for rotation by a driving means 20.

The supply roller 14 and the screw 15 are respectively disposed in transport passages 16 and 17 formed in the developing tank 11 by a partitioning wall 18 (FIG. 4), and rotatably supported through support shafts 14*a* and 15*a* thereof (FIG. 3) by the corresponding side walls of the developing tank 11 so as to be driven for rotation by the driving means 2.

It is to be noted here that the transport passages 16 and 17 are communicated with each other at the opposite sides of the developing tank 11 as shown in FIG. 3.

Subsequently, the driving means 20 for the developing units 4 and 5, the supply roller 14 and the screw 15 will be described.

Still referring to FIG. 3, a belt 21 is passed around the shaft 12*a* of the developing sleeve 12 and the shaft 14*a* of the supply roller 14, while another belt 22 is directed around the shaft 14*a* of the supply roller 14 and the shaft 15*a* of the screw 15. Meanwhile, a gear 23 is mounted on the end of the shaft 14*a* of the supply roller 14, and the gear 23 is engaged with a driving gear 25 of a motor 24.

Accordingly, when the driving gear 25 is rotated in a direction indicated by a solid line arrow, the gear 23 and the belts 21 and 22 are turned in the direction shown by a solid line arrow, and thus, the developing sleeve 12, supply roller 14 and screw 15 are respectively rotated in directions shown by arrows b, c and d in FIG. 2. It is to be noted here that the developing sleeve 12 is arranged to be rotated at 240 rpm in this embodiment.

Figure 5:
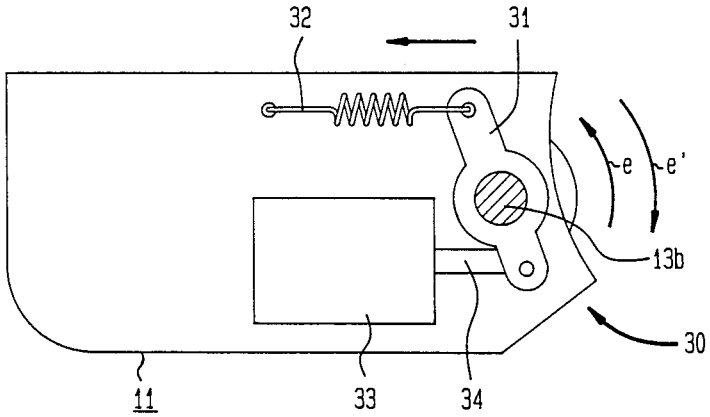
FIG. 5 is a front view showing the driving state of a moving means 30 for the magnet roller 13.
Figure 7:
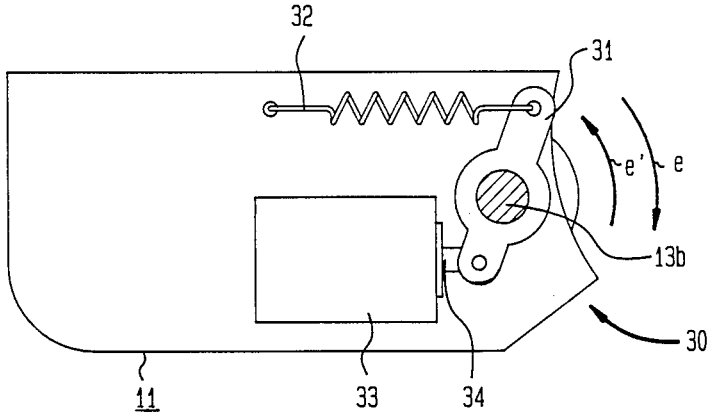
FIG. 7 is a front view showing the non-driving state of the moving means 30.

As shown in FIGS. 5 and 7, the displacing means 30 of the magnet roller 13 is constituted by a lever 31, a spring 32 and a solenoid 33. The lever 31 is fixed to the end of the shaft 13*b* for the magnet roller 13, and connected to one end of said lever 31 is the spring 32 which is also fixed to the developing tank 11 so as to normally urge the lever 31 in a direction indicated by an arrow e. Meanwhile, to the other end of the lever 31, a plunger 34 of the solenoid 33 is connected, so that upon driving of the solenoid 33, the lever 31 is rotated in the direction of an arrow e' against the urging force of the spring 32.

When the solenoid 33 is not functioning, i.e., when the lever 31 is in the state as illustrated in FIG. 5, the magnetic pole N1 of the magnet roller 13 confronts the photoreceptor drum 1, while the magnetic pole N3 is retreated at a position displaced counterclockwise by θ2 (40°) from the confronting portion with respect to the bristle height restricting member 19 as shown in FIG. 4.

Figure 6:
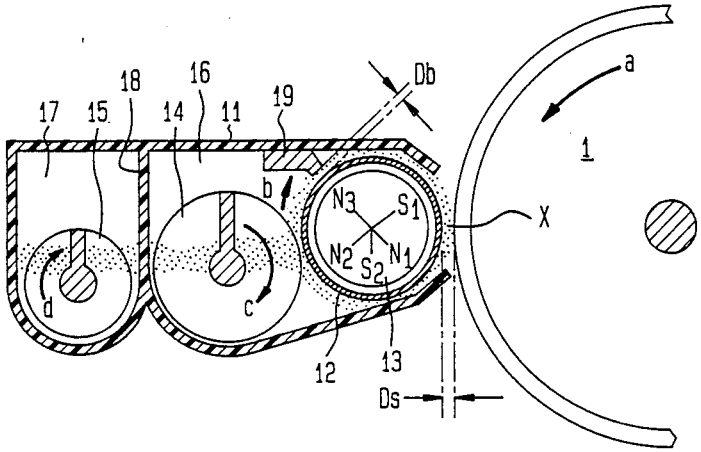
FIG. 6 is a sectional view showing the polarity arrangement of the magnet roller 13 in the state where the development is completed.

On the contrary, when the solenoid 33 is driven and the lever 31 is in the state as illustrated in FIG. 7, the magnetic pole N3 confronts the bristle height restricting member 19, while a portion intermediate between the magnetic pole N1 and the magnetic pole S1 faces the photoreceptor drum 1 (FIG. 6).

Hereinafter, the image editing mechanism 100 will be described.

Figure 8:
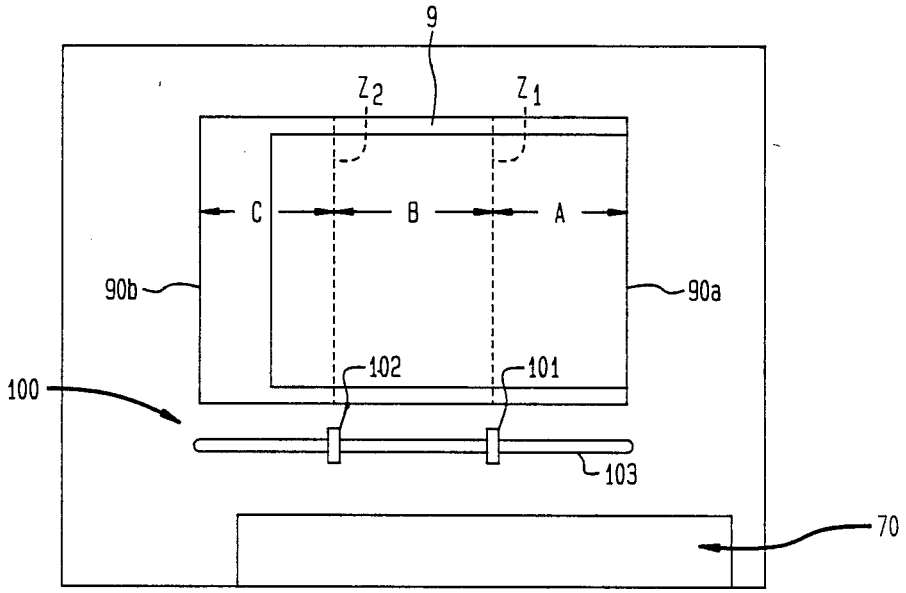
FIG. 8 is a top plan view of an image editing mechanism 100.
Figure 9:
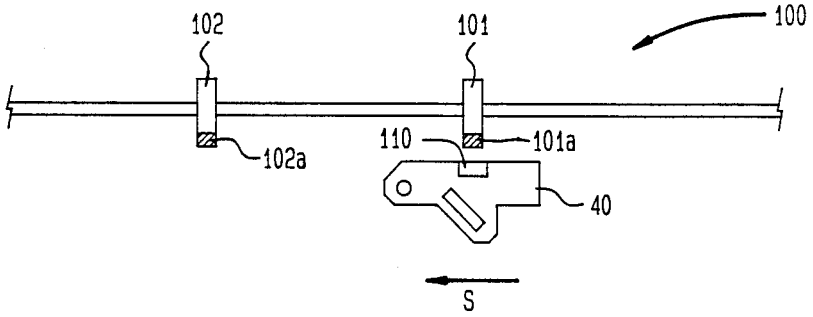
FIG. 9 is a sectional view of the image editing mechanism of FIG. 8.

In FIGS. 8 and 9, the color dividing position is selected by using at least one cursor, such as first and second levers 101 and 102 of the image editing mechanism 100 are arranged to designate regions by dividing the original document placing surface of the transparent original document platform 9 in the moving direction of the scanner 40 (in a direction indicated by an arrow S), with simultaneous designation of the reproducing color, and are slidably fitted in a guide groove 103 formed along the scanning direction of the scanner 40 at the side portion of the original document platform 9, while, within the apparatus housing, in position under the levers 101 and 102, there are respectively provided magnets 101a and 102a.

Thus, as illustrated in FIG. 8, in the state where the respective levers 101 and 102 are set, regions are designated in such a manner that the position from the forward edge 90*a* of the original document platform 9 to the first leverl 101 is a region A, the portion from the first level 101 to the second lever 102 is a region B, and the portion from the second lever 102 to the rear edge 90*b* of the platform 9 is a regions C, while the region A and C are designated as black, with the region B being designated a color such as red or yellow.

Figure 12:
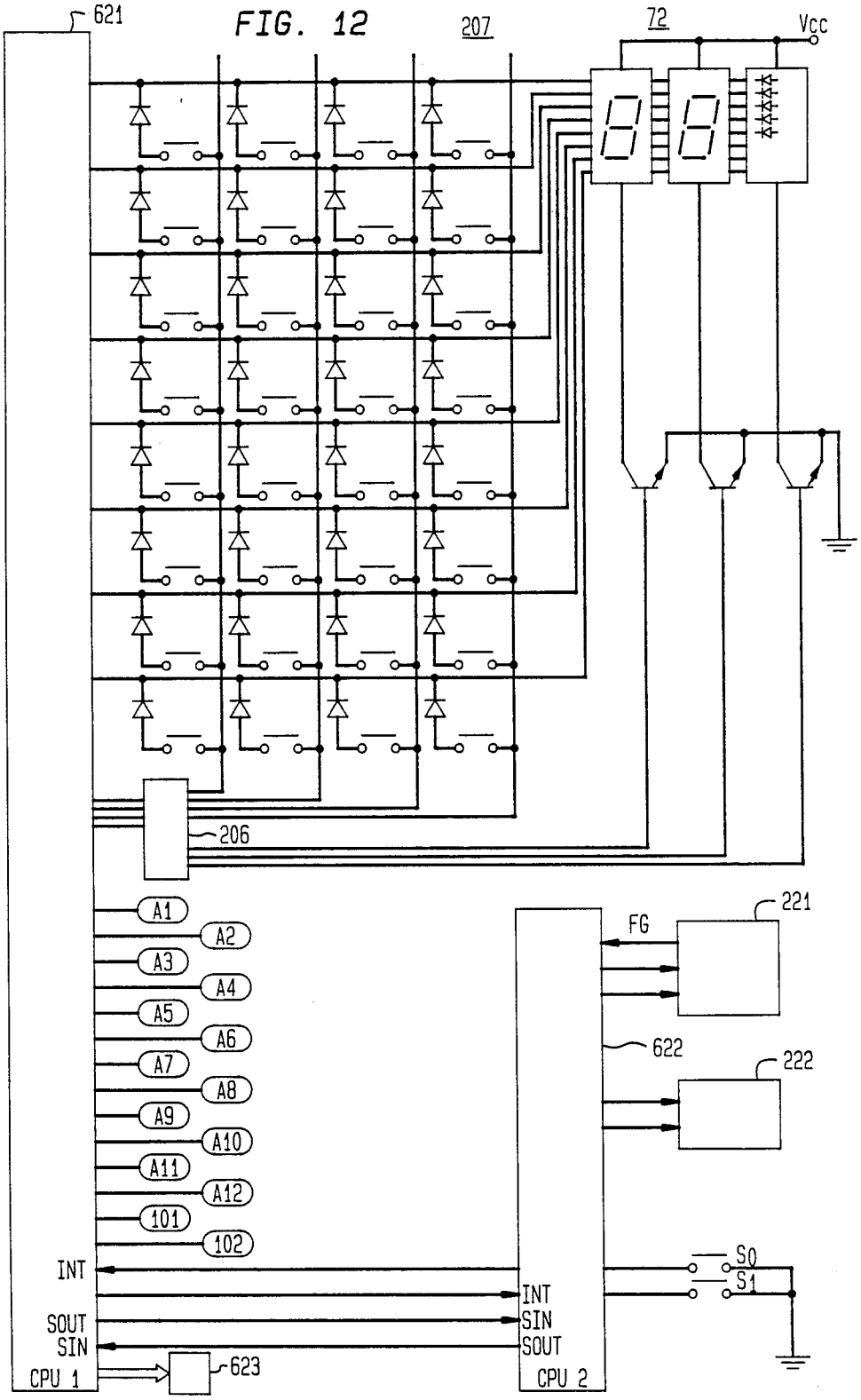
FIG. 12 is a diagram showing a control circuit of the machine.

On the other hand, a reed switch 110 is provided on the scanner 40 of the optical system 3 so as to detect the magnets 101*a* and 102*a* for applying signals thereby to a first CPU 621 of FIG. 12.

In FIG. 8, a reference numeral 70 denotes an operating panel. The operating panel 70 includes a print switch 71; numeral display 72 for indicating copy number; toner color indicating LEDs 73 to 76 each of which respectively indicates a black, red and ywllow color; toner empty indicating LED 77; ten keys 80 to 89; interrupt key 90; paper select key 92; LEDs 92*a* to 92*d* for indicating the selected paper size, each of which respectively indicates the paper size of A3, B4, A4 and B5 by illumination thereof; up and down keys 93 and 94 for changing the image density; developing unit selecting key 95 for selecting the first and second developing units; simul-color copy mode selecting key 97; simul-color copy mode indicating LED 97*a* for indicating the on state of the simul-color copy mode; book copy mode selecting key 98; and book copy mode indicating LED 98*a*.

Subsequently, a control circuit of the present invention will be explained with reference to FIG. 12.

The control circuit comprises a first micro-computer 621 for controlling the copying operation, a second microcomputer 622 for controlling the optical system and a RAM 623, these being interconnected for synchronized operation. Connected to the first CPU 621 is a switch matrix 207 including various operational keys and sensors.

Further, connected to the output terminals A1 to A12 of the first CPU 621 are a main motor, developing motor, paper feed clutch, paper re-feed clutch, solenoid for changing over the lever and the like, the on/off state of which is controlled based on the signal from the switch matrix 207.

Moreover, the numeral display 72 for indicating the copy number and various LEDs are connected to the first CPU 621 via a decoder 206 for controlling the illumination and non-illumination thereof.

The second CPU 622 has connected thereto a drive control portion 221 for controlling the D.C. motor for use in optical scanning, drive control portion 222 for driving a stepping motor for moving the lens and home position switch $S_0$, timing switch $S_1$ and the like of the optical system 3.

Next, the control operation of the first CPU 621 will be explained with reference to the flow charts shown in FIGS. 13 to 16.

Figure 13:
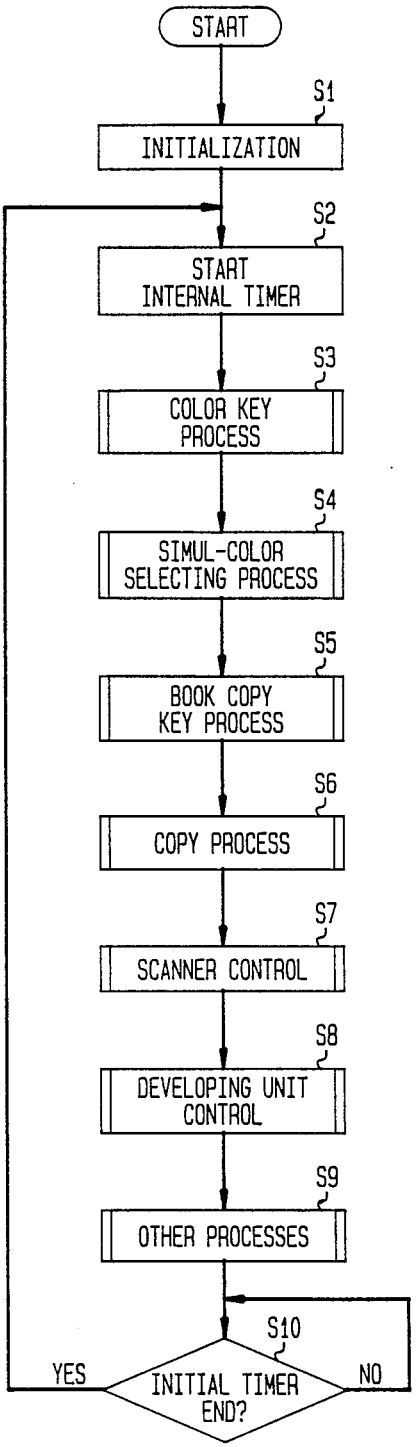
FIG. 13 is a flow chart showing a main routine.

FIG. 13 shows the main routine which controls the copying machine. When the power is turned on, flags or the like inside the microcomputer are initialized in step S1.

An internal timer is then set in step S2 for determining the time required for one routine described below. The copying machine of the present invention executes the main routine every one routine time.

A color key process routine is preformed in step S3.

Thereafter, a simul-color mode selecting process routine is performed in step S4.

Carried out in Step S5 is a book copy key process routine.

A copy operation process routine in step S6 executes the normal copying operation of a simul-color copying operation described later.

Steps S7 and S8 respectively perform a scanner control routine and a developing unit control routine.

The above-mentioned routines of steps S3 to S8 will be explained in detail hereinbelow.

Other processes are performed in step S9, followed by step S10 which determines whether the internal timer set in the step S2 is completed or not. The sequence returns to step S2 upon completion of the operation of the internal timer. If the internal timer is not completed, the sequence holds on.

Figure 14:
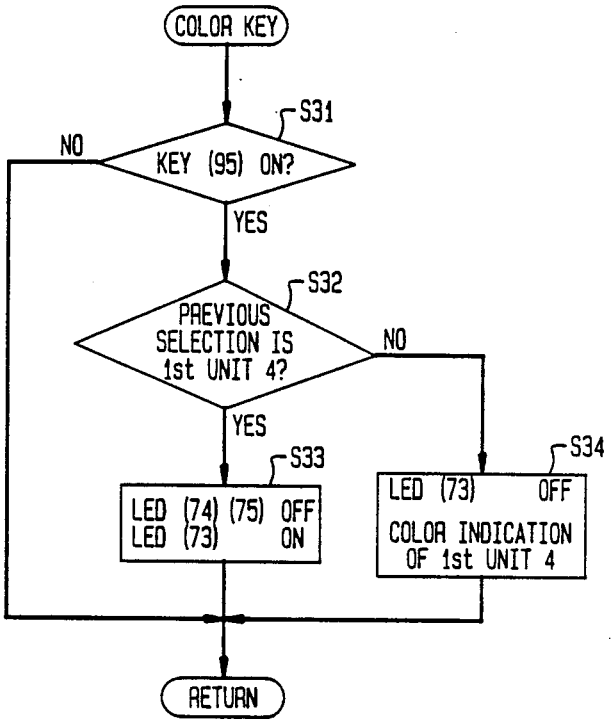
FIG. 14 is a flow chart showing a color key process routine.

Subsequently, the color key process routine will be explained with reference to FIG. 14.

The developing unit selecting key 95 is found to be on or not in step S31. If the answer is "NO", the sequence returns. If "YES", the sequence proceeds to step S32 in which it is determined whether the first developing unit 4 installed at the upper portion is selected or not before the on state of the developed unit selecting key 95 in step S31. If the answer is affirmative, the red and yellow indicating LEDs 74 and 75 are turned off and the black indicating LED 73 is lighted up. If otherwise, step S34 lights up the LED indicating the color of toner which corresponds to the color of the developer contained in the developing unit mounted as the first developing unit 4.

Figures 10, 11:
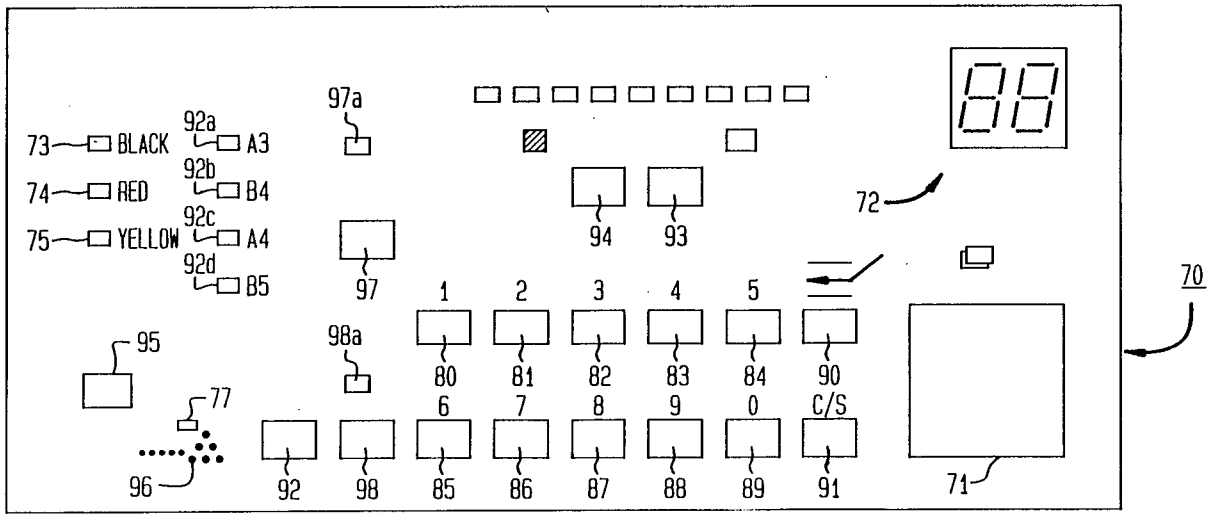
FIG. 10 is a color code table.
FIG. 11 is a plan view showing an operational panel.

The color of toner of the first developing unit 4 is determined from the color code table in FIG. 10 base on the on/off signals of the switches SW1 and SW2 inputted to the first CPU 621.

In this way, when the selecting key 95 is activated with the on state of the black indicating LED 73, the red or yellow indicating LED 74 or 75 is made to turn on according to the color of toner contained in the first developing unit 4.

Conversely, when the select key 95 is activated with the on state of the red or yellow indicating LED 74 or 75, the black indicating LED 73 is made to turn on.

Figure 15:
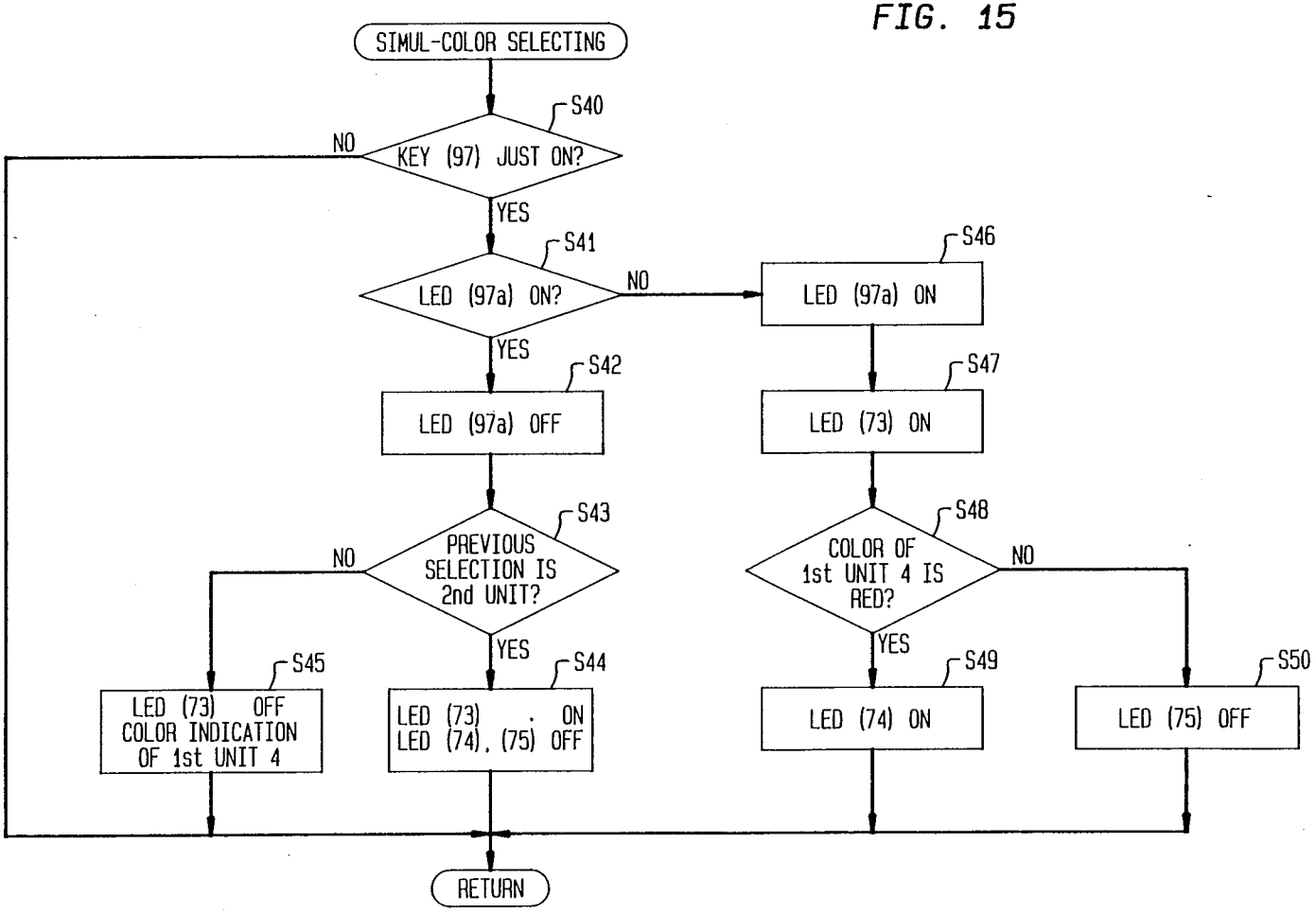
FIG. 15 is a flow chart showing a simul-color mode selecting key process routine.

FIG. 15 shows the simul-color copy mode key process routine.

Step S40 checks whether the simul-color copy mode selecting key 97 is activated or not. If the answer is "NO", the sequence is made to return. If otherwise, the sequence proceeds to step S41 to determine the on/off state of the simul-color mode indicating LED 97*a* for checking whether the simul-color copy mode has been designated before the key 97 was depressed. If the simul-color mode indicating LED 97*a* is in the on state, it is turned off to release the simul-color copy mode in step S42. Before the key 97 is turned on, a storing operation is done as to which developing unit is selected, i.e., the first developing unit 4 mounted at the upper portion or the second developing unit 5 mounted at the lower portion. For this, step S43 follows the step S42 checks whether the second developing unit 5 mounted at the lower portion has been selected or not depending upon the designation of the simul-color copy mode. If the answer is affirmative, the black indicating LED 73 is turned on as well as both the red and yellow indicating LEDs 74 and 75 are turned off in step S44. If otherwise, the black indicating LED 73 is turned off and the color of toner contained in the first developing unit 4 is displayed in step S45.

The color of toner contained in the first developing unit 4 is determined from the color code table in FIG. 10 based on the on/off signals of the switches SW1 and SW2 inputted to the first CPU 621.

When steps S40 and S41 respectively make the simul-color copy mode selecting key 97 and the simul-color copy mode indicating LED 97a turn on, step S46 activates the simul-color copy mode indicating LED 97a to effect the simulcolor copy mode. Subsequently, the black indicating LED 73 is turned on in step S47. Thereafter, it is checked in step S48 whether the first developing unit 4 contains the developer of red color. If the result is "YES", the red indicating LED 74 is turned on in step S49, and if otherwise, the yellow indicating LED 75 is turned on in step S50.

Figure 16:
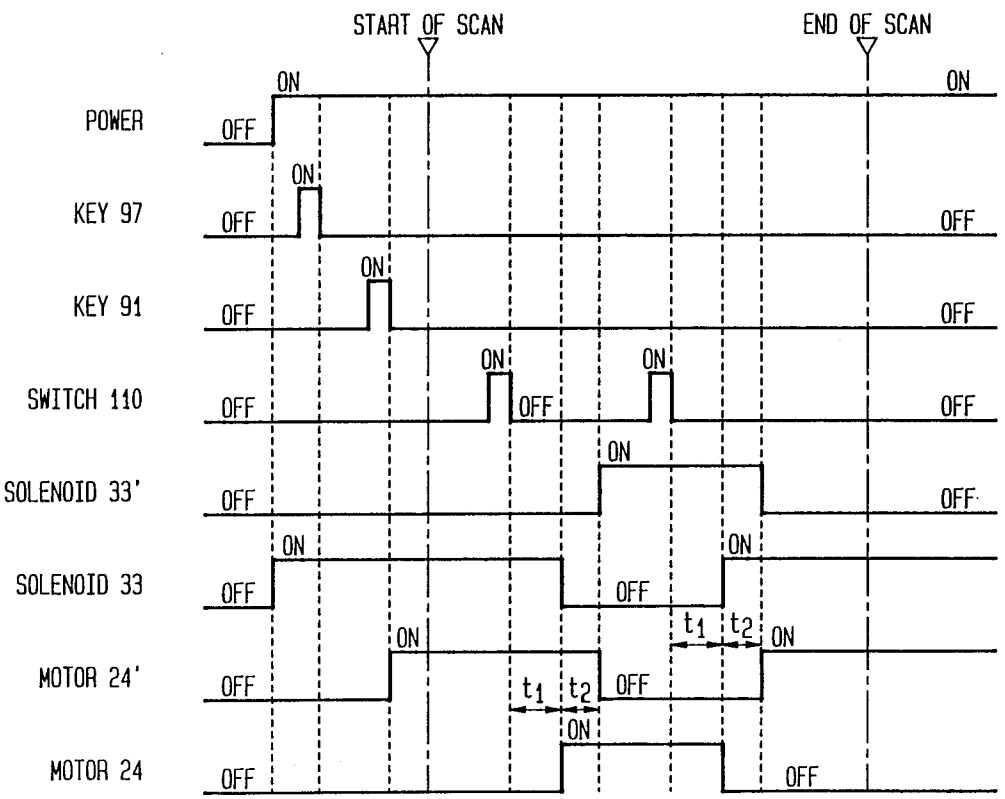
FIG. 16 is a timing chart showing a simul-color copying operation.

Subsequently, the operation of the simul-color copy mode will be explained with reference to FIG. 16. It should be noted here that the numerals for the constituent elements of the second developing unit 5 are marked with "prime" (') for differentiation from those of the developing unit 4.

In the first place, when the power source is turned on through operation of a main switch (not shown) for the copying apparatus, the intermediate portion between the magnetic poles N1 and S1 of the magnet roller 13 confronts the photosensitive surface of the photoreceptor drum 1 in the first developing unit 4 as shown in FIG. 6, while the magnetic pole N1 faces said surface in the second developing unit 5 as illustrated in FIG. 4.

Upon turning on of the print switch 71 in the above state, the second developing unit 5 containing the black toner is automatically driven for effecting the normal copying function, and when the simul-color copy mode selecting key 97 is turned on, the setting is so made that the simul-color copying can be effected. It is to be noted, however, that even if this simulcolor copy mode selecting key 97 is depressed during the copying operation, the simul-color copying is not carried out.

When the simul-color copy mode selecting key 97 is turned on, the copying mode is altered from the normal copying to the simul-color copy mode.

In the above state, the regions A and C for effecting the white and black copying, and the region B for effecting the color copying are designated as shown in FIG. 8 by sliding the first and second levers 101 and 102 along the sliding groove 103.

It should be noted here that the levers 101 and 102 are effective only when the simul-color copy mode is selected, and arranged not to function at all, even if operated at a time other than above.

Under the state set as described so far, when the print switch 71 is turned on, with an original document S placed on the original document platform 9 as shown in FIG. 8, a developing motor 24' for the second developing unit 5 is started, and the developing sleeve 12', supply roller 14' and screw 15' are respectively rotated in the directions indicated by the arrows b, c and d.

Accordingly, the developer containing the black toner and accommodated in the developing tank 11' is circulated for transportation through the transport passages 16' and 17', while being mixed and stirred based on the rotation of the supply roller 14' and screw 15', and part of the developer is supplied onto the surface of the developing sleeve 12' by the supply roller 14' so as to form the magnetic brush of the developer on said developing sleeve.

The magnetic brush thus formed passes through the brush bristle height restricting gap Db as it is cut off by the bristle height restricting member 19' based on the rotation of the developing sleeve 12' so as to be successively fed out onto the developing region X' for establishing the state capable of developing the electrostatic latent image formed on the photosensitive surface of the photoreceptor drum 1.

Meanwhile, based on the turning on of the print switch 71, the scanner 40 starts functioning in the direction of the arrow S so as to project light onto an original document placed on the original document platform 9, and the light reflected therefrom is projected onto the photosensitive surface of the photoreceptor drum 1 at the exposure point W so as to form the electrostatic latent image of the original document on said surface. The latent image thus formed is first developed by the second develping unit 5.

Subsequently, when the magnet 101a of the first lever 101 is detected by the reed switch 110 of the scanner 40, said reed switch 110 applies its signal to the first CPU 621 of FIG. 12.

It is to be noted here that at this point in time, the latent image corresponding to a boundary portion Z1 between the regions A and B where changeover is effected from black to a selected color, is located at the exposure point W on the photosensitive surface of the photoreceptor drum 1, and during the time period (t1=0.22 sec) in which the boundary portion Z1 is displayed from the position of the exposure point W up to the developing region X of the first developing unit 4, only the second developing unit 5 is successively operated.

After a timer period t1 from the turning on of the reed switch 110, when the boundary portion Z1 of the electrostatic latent image reaches the developing region X, the first developing motor 24 is turned on, while the first developing solenoid 33 is turned off. By the above operation, the first developing unit 4 is set in a state as shown in FIGS. 4 and 5 in the similar manner as in the second developing unit 5, with the developing sleeve 12, supply roller 14 and screw 15 being respectively rotated in the directions indicated by the arrows b, c and d, and the magnetic brush is formed on the surface of the developing sleeve 12, thereby establishing the state capable of developing the latent image on the surface of the photoreceptor drum 1. Thus, at the first developing unit 4, a function of supplying the color toner (red or yellow) to the latent image corresponding to the region B is started.

Then, after a time period t2 from the starting of the first developing motor 24, i.e., after the time (t2=0.2 sec.) required for the boundary portion Z1 of the latent image to move from the developing region X to the developing region X' for the second developing unit 5, the motor 24' of the second developing unit 5 is turned off, while the second developing unit solenoid 33' is turned on. By the above functions, the second developing unit 5 is set in the state as shown in FIGS. 6 and 7, and the intermediate portion between the magnetic poles N1 and S1 confronts the surface of the photoreceptor drum 1, with the developing sleeve 12, supply roller 14 and screw 15 stopping rotation, and thus, the developing function for the region A by the black toner is terminated.

When the scanner 40 is further displaced, and reaches the position of the second lever 102, i.e., the boundary portion Z2 beteen the regions B and C, the reed switch 110 detects the magnet 102a so as to be again turned on for outputting the signal to the first CPU 621. It is to be noted here that at this time, the electrostatic latent image corresponding to the boundary portion Z2 is located at the exposure point W.

After a time period t1 from the turning on of the reed switch 110, i.e., when the electrostatic latent image at the boundary portion Z2 reaches the developing region X, the first developing motor 24 is turned off, with the turning on of the first developing solenoid 33, and thus, color developing for the region B is terminated.

Further, after the time period t2, i.e., when the boundary portion Z2 of the electrostatic latent image located at the developing region X reaches the developing region X' of the second developing unit 5, the second developing motor 24' is turned on, while the second developing solenoid 33' is turned off, and the black development for the region C is started.

The above function is maintained up to the termination of the scanning, and thus, the development for the region C is completed.

By the above operation, during the period from the starting of the scanning up to the completion thereof, a two-color composite copy, in which the developing color is changed over from black to color, and further, to black, is obtained.

It is to be noted here that, in the above embodiment, although it is so arranged that the developing color is changed over in the order from black to color, and further, to black, the coloring pattern is not limited to the above, but the image editing pattern can be altered in any way, for example, by increasing the number of levers or changing the order of the developing units to be used for the starting of the development.

Moreover, in the foregoing embodiment, although the case where the twocolor print is to be obtained by providing the two developing units 4 and 5 around the photoreceptor drum 1 has been described, the arrangement is not limited to the above, but may be, for example, so modified as to provide three or four developing units around the photoreceptor drum 1, thereby to obtain color prints in three or four colors.

Furthermore, in the foregoing embodiment, although the arrangement is so made that, during the non-developing period, the developing motor 24 is stopped, with the magnet roller 13 rotated so as to retreat the magnetic pole from the developing region X for displacement thereof to the portion confronting the bristle height restricting member 19, the magnetic pole need not necessarily be displaced as in the above embodiment between the developing period and the non-developing period. However, if it is arranged as in the embodiment, the possibility in which the magnetic brush contacts the photoreceptor drum 1 is reduced to prevent the mixing of colors.

Further, in the foregoing embodiment, although the red or yellow developing unit is used as the first developing unit 4 and the black developing unit is selectively provided as the second developing unit 5, any one of the black, red and yellow developing units can selectively be provided as the first and second developing units 4 and 5 respectively to form a composite copy having red and yellow color.

Similarly, the arrangement for subjecting the exposure lamp 41 to a scanning function, with the original document platform 9 fixed in the foregoing embodiment, may be modified so that the original document platform 9 is caused to scan, with the exposure lamp 41 held stationary.

Figure 17A:
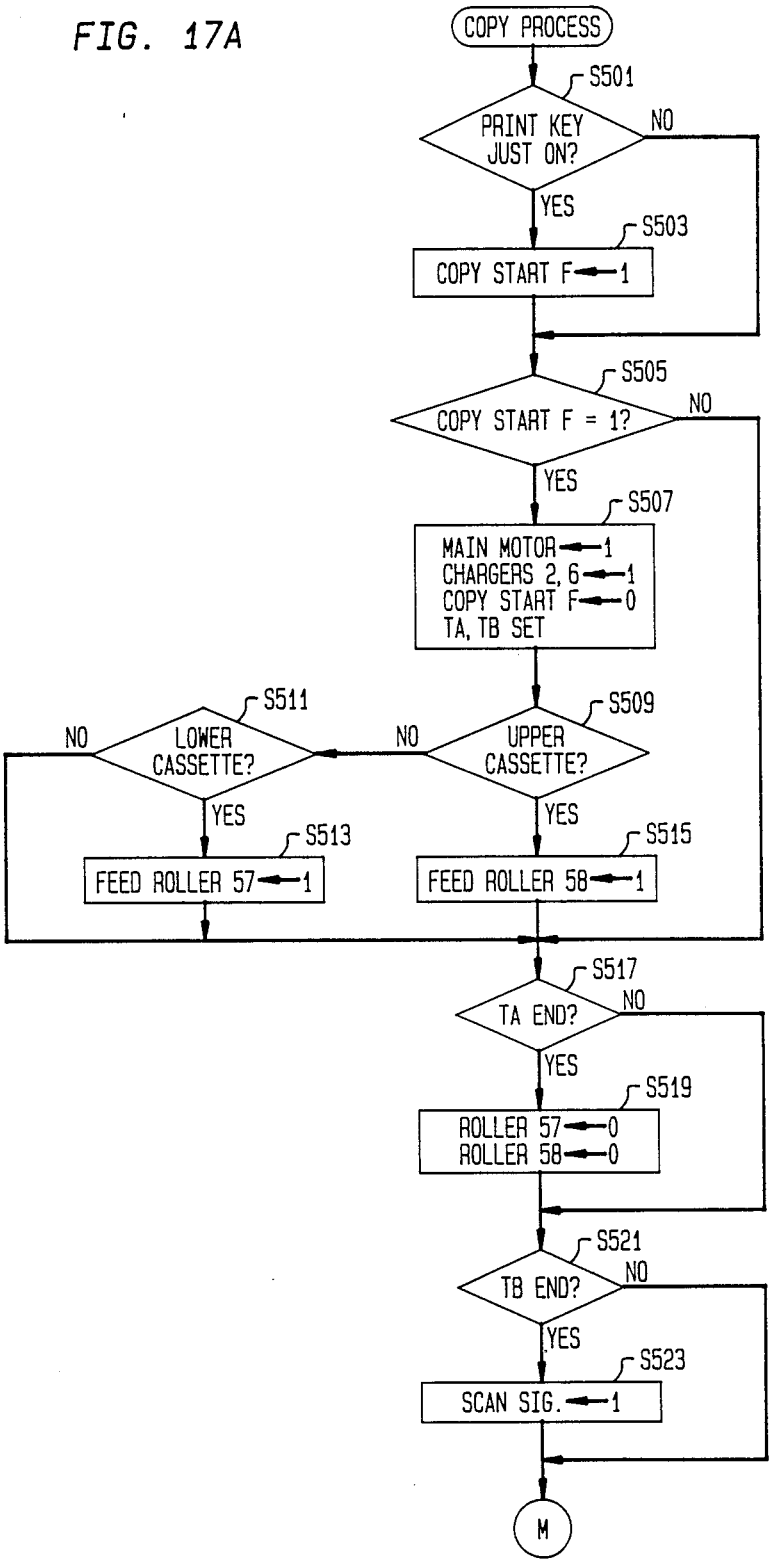
FIGS. 17(a) and (b) are flow charts showing a copying operation process routine.
Figure 17B:
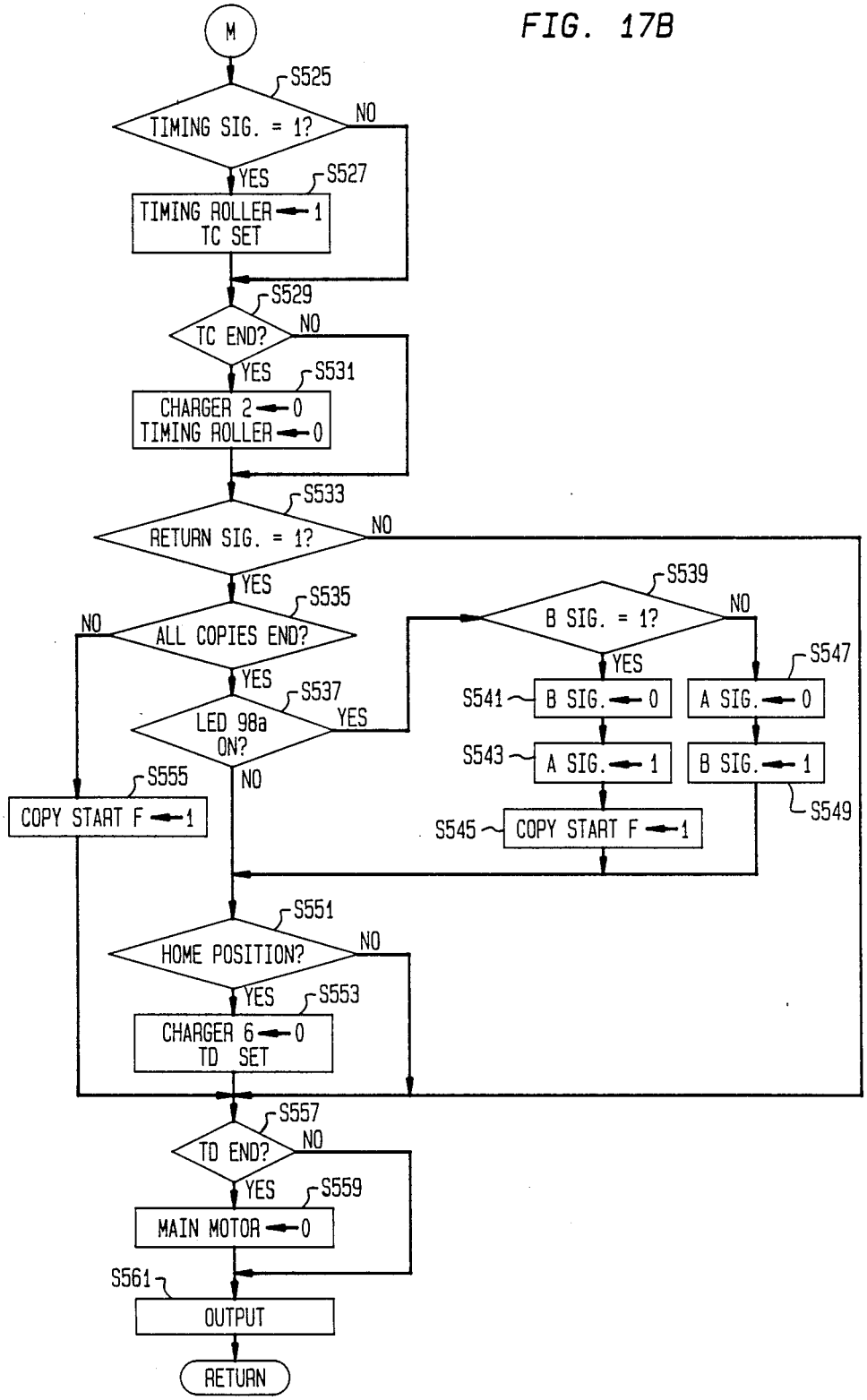

FIGS. 17(*a*) and 17(*b*) are flow charts showing in detail the routine for the copying operation process.

The copying operation process is started upon the detection of the input of the print key 71 in step S501.

A copy start flag is set to "1" in step S503 and the subsequent step S505 checks the state of this flag. Then, the main motor not shown, charger 2 and transfer charger 6 are turned on, timers TA and TB are set and the copy start flag is reset in step S507. The timers TA and TB respectively determine the time at which the clutches of the feed rollers 57 and 58 are turned off and the time at which the scanning operation is started.

In the following steps S509 to S515, the clutch of one of the feed rollers 57 and 58 for the cassette selected from the upper and lower cassettes 50 and 51 is turned on to start the feed of copy paper.

Subsequently, the timer TA is checked in step S517 for the completion of operation, followed by turning of the clutch of one of the feed rollers 57 and 58 to terminate the copy paper feed in step S519.

The timer TB is checked in step S521 for the completion of operation, then, a scan signal delivered to the second CPU 622 is set to "1" in step S523. The second CPU 622 starts the scanning process as described later upon receiving the signal.

Step S525 judges a timing signal delivered from the second CPU 622.

When the timing signal is detected to be "1", the clutch of the timing roller 52 is turned on, so that the copy paper is transported between the photoreceptor drum 1 and the transfer charger 6 to start the transfer operation to the copy paper. A timer TC is set in step S527. The timer TC determines the time at which the scanning and charging operations are terminated and at which the clutch of the timing roller 52 is turned off (steps S529 and S531), said time being set according to the size of the selected copy paper and the set magnification.

Figure 19:
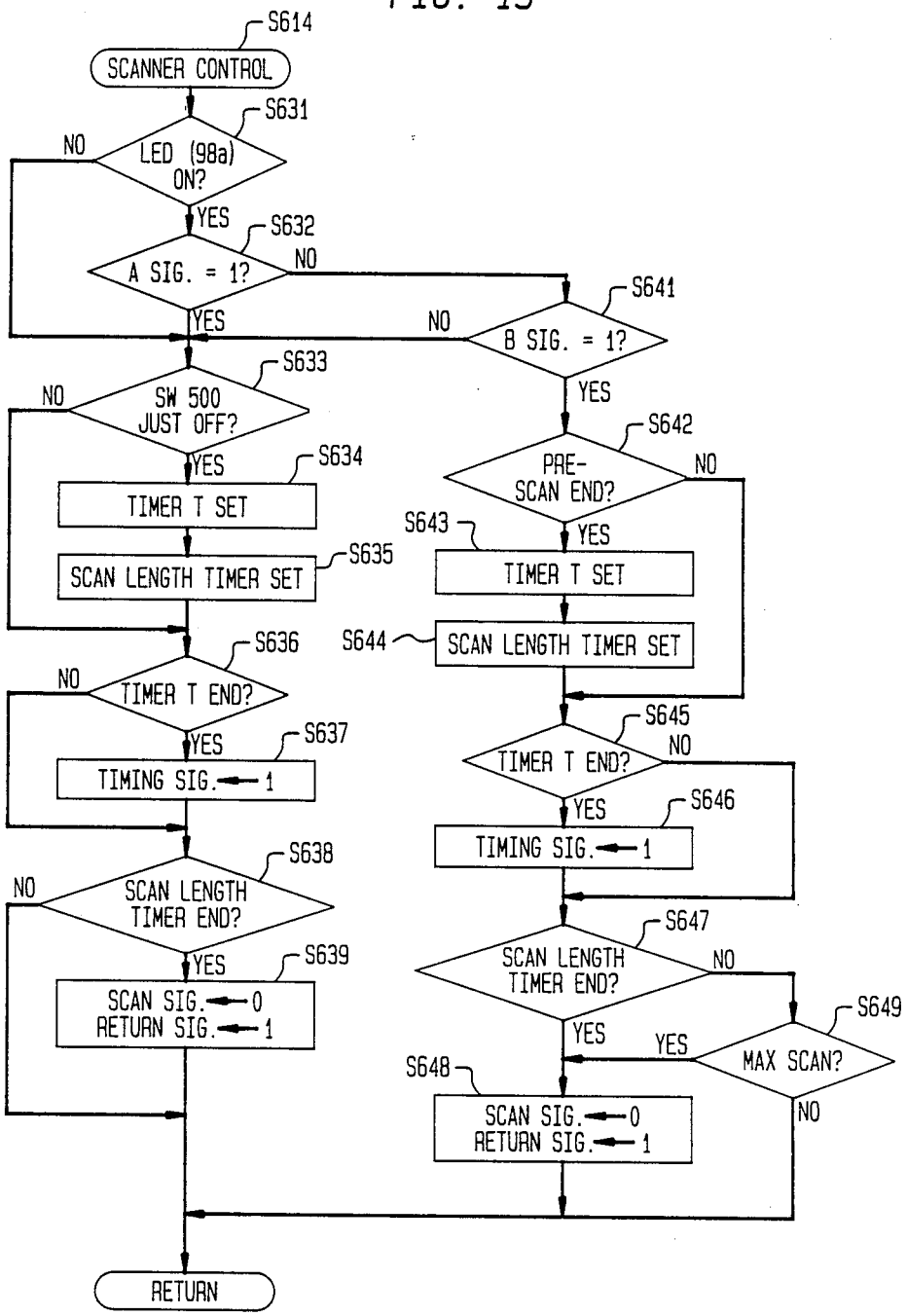
FIG. 19 is a flow chart showing a scanner control.

The next step S535 checks whether a return signal described later in FIG. 19 is set to "1" in step S533. If the answer is affirmative, it is checked in step S535 whether the multi-copy operation is completed. If the result of the check is "YES", step S537 determines whether the book copy mode is designated by illumination of the LED 98*a*. In the case where the book copy mode is designated, a B-surface copy signal is judged to be "1" in step S539. The B-surface copy defines the first copying operation for copying the area of the downstream side with respect to the scanning direction, while a A-surface copy defines the second copying operation for copying the area of the upstream side with respect to the scanning direction.

When the B-surface copy signal is "1" in step S539, the B-surface copy signal is set to "0" in step S541, the A-surface copy signal is set to "1" in step S543 and the copy start flag is set in step S545 to make preparation for effecting the second copying operation, i.e., the A-surface copying. When the B-surface copy signal is not "1" in step S539, the A-surface copy signal is set to "0" in step S547 since the A-surface copy signal has been "1", and the B-surface copy signal is set to "1" in step S549. The A-surface and B-surface copy signals are delivered to the second CPU 622.

Subsequently, the second CPU 622 generates a home position signal due to the return of a first scanning member to a reference position in step S551, the transfer charger 6 is turned off and a timer TD is set in step S553. The timer TD determines the time at which the main motor should be turned off (steps S557 and S559).

In the case where the multi-copy operation is not completed in step S535, the copy start flag is set in step S555 for executing the copying operation again.

In the following step S561, the outside devices are controlled by delivering the aforesaid various control signals, and also, the signals to other CPUs are transmitted.

In this way, the copying operation is performed.

Figure 18:
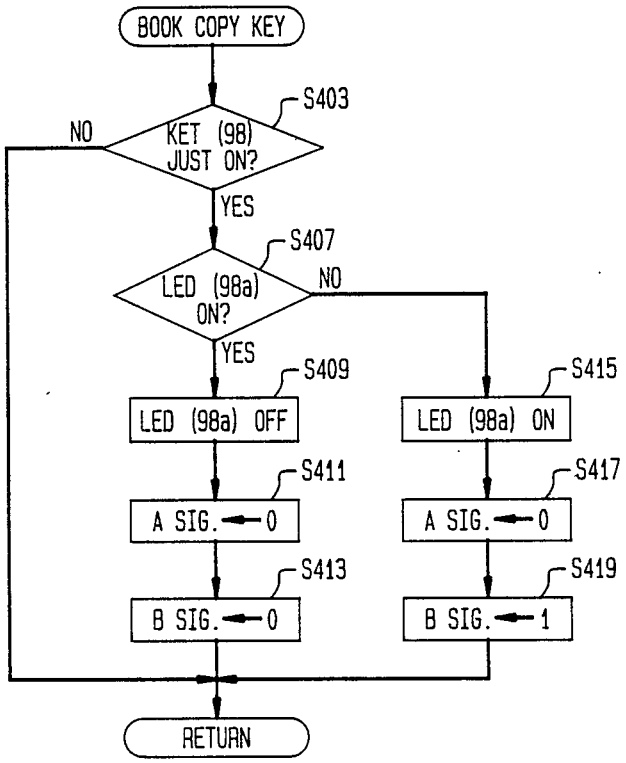
FIG. 18 is a flow chart showing a book copy mode key process routine.

FIG. 18 is a flow chart showing in detail the book copy mode key process routine.

When the book copy mode key 98 is turned on, it is judged in step S407 whether the book copy mode indicating LED 98a is lighted up. The affirmative answer to the inquiry of step S407 represents that the book copy mode has already been designated, therefore, said LED 98s is extinguished to release the designation of the book copy mode in step S409 and the A-surface and B-surface copy signals which should be delivered to the second CPU 622 are set to "0" in steps S411 and S413. When the book copy mode indicating LED (8a is found to be off in step S407, the LED 98a is turned on to designate the book copy mode in step S415, the A-surface copy signal is set to "0" in step S417 and the B-surface copy signal is set to "1" in step S419. The B-surface copy signal set to "1" is used for the check as to whether the book copy mode is specified at step S539 in FIG. 17(b).

FIG. 19 shows the scanner control routine (step S614). A normal scanner control is done when the book copy mode indicating LED 98a is turned off, i.e., in the normal copy mode in step S631 or when the LED 98a is turned on, i.e., in the book copy mode as well as in the scanning operation for the A-surface and is effected in step S632. Upon leaving the scanner from the scanner home position switch SW 500 in step S633, a scan length timer is set (steps S634 and S635), said timer being decided by the value of paper length x magnification and a timer T for the output of the timing signal determined by calculating based on the scanning speed. Upon completion of operation of the timer T in step S636, the timing signal is set to "1" in step S637. Further, when the scan length timer is terminated in step S638, the scanning signal is set to "0" and the return signal is set to "1" in step S639.

On the other hand, in the case of the scanning operation for the B-surface of the book (step S642), the some process steps as mentioned above are performed (steps S643 to S648) after scanning in an amount corresponding to the value of paper length x magnification in steps S642. It should be noted here that, when the scanner arrives at the longest scanning portion (420 mm) before completion of operation of the scan length timer, the scanning operation is terminated at this point and the return operation is started in step S648.

Figure 20:
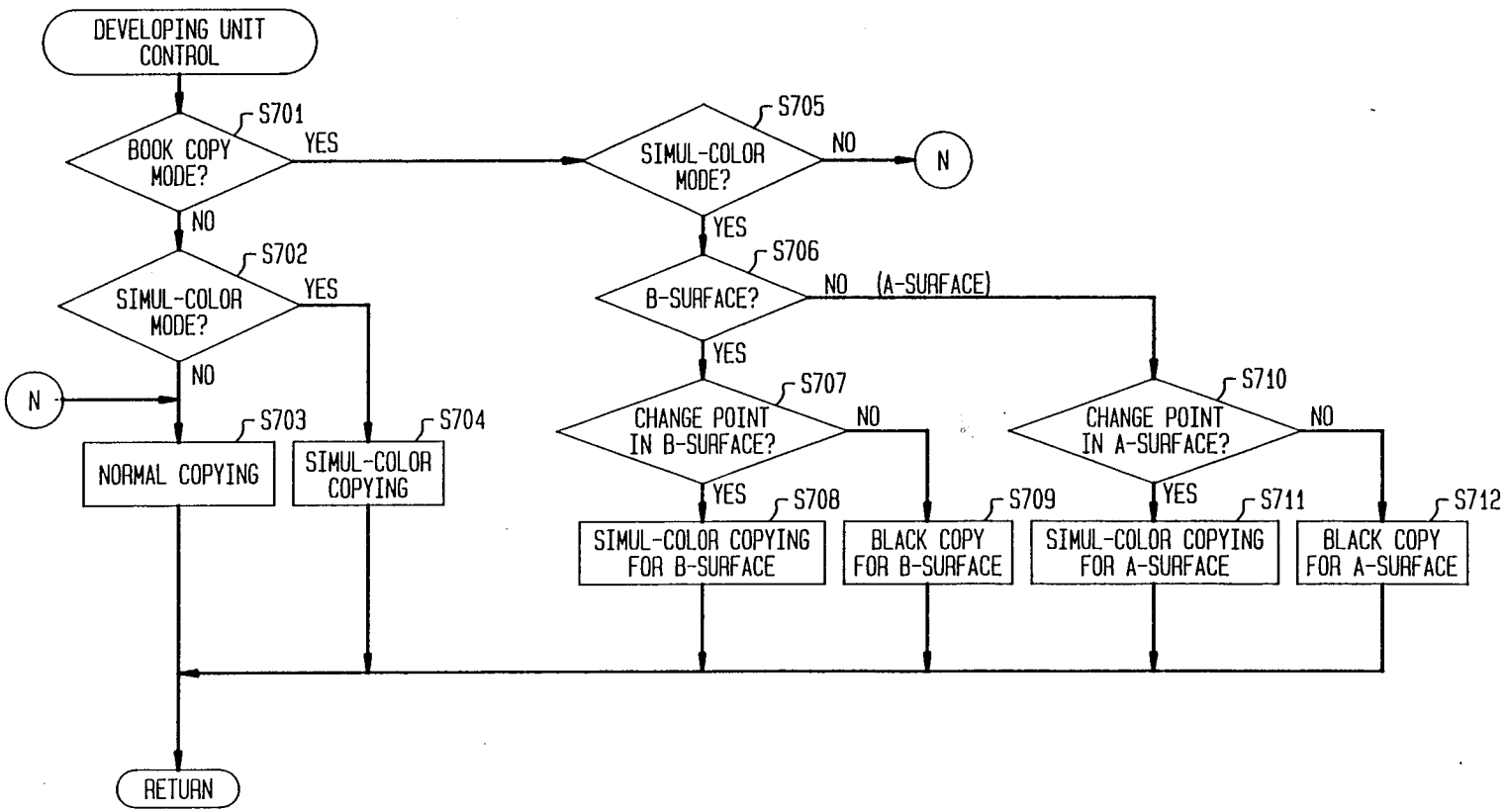
FIG. 20 is a flow chart showing a developing unit control routine.

FIG. 20 is a flow chart showing a developing unit control routine.

A check is made in step S701 as to whether the book copy mode is specified. If result of the check is "NO", the simul-color copy mode is judged to be designated in step S702. If the answer is negative, the development is performed by using the selected developing unit in step S703. In the case of the simul-color copy mode ("YES" in step S702), the original which is divided in the scanning direction with the changing point specified by the lever as a boundary is copied in step S704 such that the upstream side thereof is developed in color and the downstream side in black by using two developing units 4 and 5.

When the book copy mode is specified without designation the simul-color copy mode ("YES" in step S701 and "NO" in step S705), each page of the book i.e., the A-surface and B-surface, is developed by the selected developing unit.

Figure 21A:
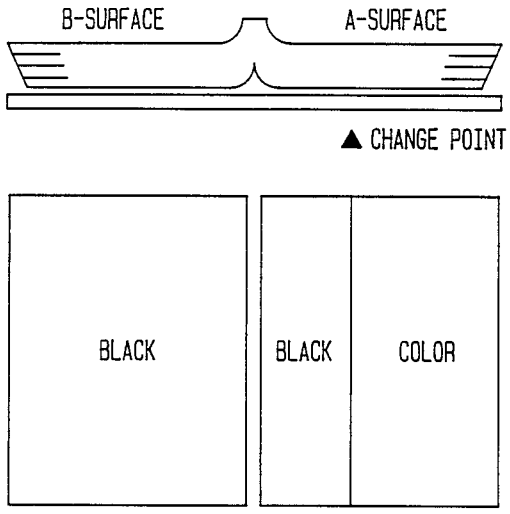
FIGS. 21(a) and (b) are explanatory views showing a copying operation.
Figure 21B:
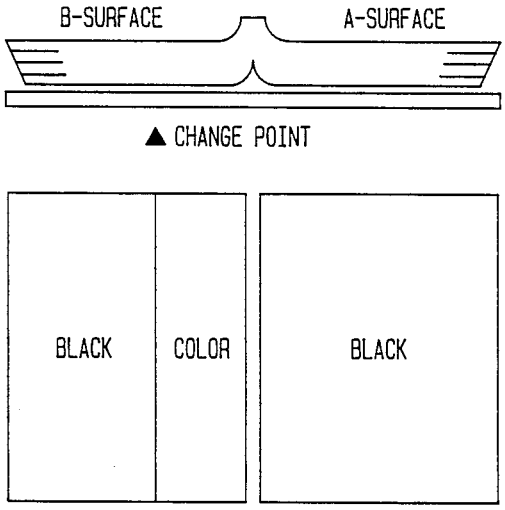

Subsequently, when the book copy mode is specified in step S701 with the simul-color copy mode designated in step S705, it is checked in step S706 whether the B-surface is ready to be copied. If the inquiry of step S706 is answered with "YES", step S707 judges whether the change point is in the B-surface. If the answer is affirmative, the B-surface which is divided with the change point set as a boundary is copied in step S708 such that the front half page is developed in color by the first developing unit 4 and the rear half page is black by the second developing unit 5 as shown in FIG. 21(b). When there is no change point in the B-surface ("NO" in step S707), the B-surface is copied in step S709 by using the developing unit selected before the designation of the simul-color copy mode. In this flow chart, the black developing unit is employed.

In a case of the negative answer to the inquiry of step S706, it is checked whether the change point is in the A-surface in step S710. If the answer is affirmative, the A-surface which is divided with the change point set as a boundary is copied in step S711 such that the front half page is developed in color by the first developing unit 4 and the rear half page in black by the second developing unit 5, as shown in FIG. 21(a). When there is no change point in the A-surface ("NO" in step S710), the A-surface is copied in step S712 by using the developing unit (in this case, the black developing unit) selected before the designation of the simul-color copy mode.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying machine comprising:

a platen on which an original is placed;

a photosensitive member;

scanning means for scanning the original on the platen in a scanning direction to project a narrow, elongated image of the original onto the photosensitive member;

image forming means arranged around the photosensitive member and comprising a plurality of developing units, each of which containing toner of a different color;

input means for inputting an instruction to start an image forming operation;

means for establishing an area dividing position which divides a copying area on the platen into two copying areas in the scanning direction;

first mode designating means for designating a divisional copy mode in which the two copying areas divided at the area dividing position are separately and successively copied;

means for setting at least one color dividing position which divides one of the copying areas on the platen into a plurality of color regions in the scanning direction;

second mode designating means for designating a simulcolor copy mode during a copying operation in which a multi-color copy image is obtained by selectively changing over at least from a first one of the plurality of developing units to a second one of the plurality of developing units to form a plurality of regions having different color which are on opposite sides of the color dividing position; and control means, when the first and second mode designating means simultaneously designate the divisional copy mode and the simul-color copy mode, for controlling the scanning means and the image forming means such that two copying areas specified at the area dividing position are separately copied, as well as for effecting the change-over control of the developing units during the copying operation to form the regions of different colors which are separated at the color dividing position.

2. A copying machine as claimed in claim 1, wherein the means for establishing the area dividing position determines the area dividing position based on a size of paper to be used and a magnification ratio to be used during the copying operation.

3. A copying machine as claimed in claim 2, wherein the means for setting the color dividing position includes at least one cursor movably mounted adjacent a side of the platen for movement along the scanning direction and a member for detecting the position of the cursor.

4. A copying machine as claimed in claim 1, wherein the control means controls a respective one of the developing units containing toner of a predetermined color such that the color dividing position is not included in a respective one of the regions having different colors.

5. A copying machine as claimed in claim 4, wherein the predetermined color is black.

6. A copying machine as claimed in claim 3, wherein the at least one cursor comprises two levers, each of which includes a magnet, and the member comprises a reed switch movably mounted for movement in the scanning direction in proximity to the magnet of each of the levers, the reed switch being operatively connected to the control means for outputting a color dividing position signal each time the reed switch passes a respective one of the levers.

7. A copying machine as claimed in claim 1, further comprising paper supply means for supplying sheets of paper of at least one size and transfer means for transferring sheets of paper from the supply means to the photosensitive member such that an image formed by toner supplied to the photosensitive member by the image forming means is transferred to one of the sheets of paper during the copying operation.

8. A copying machine as claimed in claim 1, wherein the scanning means includes a scanner movably mounted for movement in the scanning direction.

9. A copying machine as claimed in claim 7, wherein the control means effects the change-over control of the developing units by operating the first and second developing units simultaneously during the copying operation.

10. A copying machine as claimed in claim 9, wherein the control means prevents operation of one of the developing units when the image formed by toner of one color from the one developing units reaches a position corresponding to the color dividing position at which another one of the developing units supplies toner of a color different from the one color to the sheet of paper during the copying operation.

11. A copying machine as claimed in claim 9, wherein the photosensitive member comprises a photosensitive drum rotatably mounted for movement of a surface of the drum in a circular path, the first developing unit being disposed at a first position along the path and the second developing unit being disposed at a second position along the path downstream of the first position, the control means preventing operation of the first developing unit for a predetermined amount of time while the scanning means projects a first part of the image of the original on the photosensitive drum and then operating the first and second developing units simultaneously while the scanning means projects a second part of the image of the original on the photosensitive drum, the second part of the image being downstream from the first part of the image with respect to the scanning direction.

12. A copying machine as claimed in claim 1, wherein each of the developing units includes toner indicating means for indicating to the control means the color of the toner contained therein.

13. A copying machine as claimed in claim 1, wherein each of the developing units includes a magnetic brush means for supplying toner to the photosensitive member, the magnetic brush means including a magnet roller having at least one magnet pole, the magnet roller being rotatably mounted such that the magnet pole is movable from a first position facing the photosensitive member to a second position away from the photosensitive member, the magnetic brush means further including driving means operatively connected to the control means for selectively moving the magnet pole to the first and second positions.

14. A copying machine as claimed in claim 13, wherein the driving means comprises a lever connected to the magnet roller and a solenoid having a movable plunger connected to the lever at a position spaced from a position at which the magnet roller is connected to the lever, whereby movement of the plunger effects rotation of the magnet roller.

15. A copying machine as claimed in claim 3, wherein the at least one cursor comprises two cursors, each of which is movably mounted adjacent a side of the platen for movement along the scanning direction, the member detecting the position of each of the cursors.

* * * * *